US007663040B1

(12) United States Patent
Hsieh

(10) Patent No.: US 7,663,040 B1
(45) Date of Patent: Feb. 16, 2010

(54) POSITIONING DEVICE FOR A CYMBAL

(75) Inventor: Wu-Hong Hsieh, Taipei Hsien (TW)

(73) Assignee: K.H.S. Musical Instrument Co., Ltd. (TW)

( * ) Notice: Subject to any disclaimer, the term of this patent is extended or adjusted under 35 U.S.C. 154(b) by 0 days.

(21) Appl. No.: 12/234,812

(22) Filed: Sep. 22, 2008

(51) Int. Cl.
*G10D 13/02* (2006.01)

(52) U.S. Cl. ..... 84/421; 248/187.1

(58) Field of Classification Search ..... 84/421, 84/422.3; 248/187.1
See application file for complete search history.

(56) References Cited

U.S. PATENT DOCUMENTS 6,268,556 B1 * 7/2001 Liao ..... 84/421

* cited by examiner

*Primary Examiner*—Jianchun Qin
(74) *Attorney, Agent, or Firm*—Hershkovitz & Associates, LLC; Abraham Hershkovitz

(57) ABSTRACT

A positioning device for a cymbal has a bracket, a clamp, a cymbal supporting assembly, two friction pads and a primary adjusting assembly. The bracket has a stationary clamping member. The clamp is mounted movably on the bracket and has a movable clamping member. The cymbal supporting assembly is mounted pivotally between the stationary clamping member of the bracket and the movable clamping member and has a friction wheel and a cymbal supporting rod. One of the friction pads is mounted between the stationary clamping member and one side of the friction wheel. The other friction pad is mounted between the movable clamping member and the other side of the friction wheel. The friction pads selectively presses respectively against the sides of the friction wheel of the cymbal supporting assembly. The positioning device with the friction pads precisely sets the angular position of the cymbal.

10 Claims, 4 Drawing Sheets

POSITIONING DEVICE FOR A CYMBAL

BACKGROUND OF THE INVENTION

1. Field of the Invention

The present invention relates to a positioning device, and more particularly to a positioning device that holds a cymbal and changes the angular position of the cymbal with a stepless adjustment to advantage a precise angular position of the cymbal.

2. Description of Related Art

A conventional positioning device for holding a cymbal has a post, a body, a supporting rod and an adjustment knob. The post is mounted on a bottom plate to stand on the ground. The body is formed on the post and has a ring of engaging keys. The supporting rod is mounted pivotally on the body, holds a cymbal and has a connecting end and a mounting block. The mounting block is formed on the connecting end, is engaged rotatably with the body and has a ring of engaging keyways corresponding respectively to the keys on the body. The adjust knob has a bolt mounted through the body and the mounting block and selectively presses the mounting block against the body to engage the keys with the keyways to hold the supporting rod with the cymbal at a desired angular position.

However, the number of the keys and keyways limits the precision of the angular adjustment to the supporting rod. A user always cannot precisely position the supporting rod at a desired angular position.

To overcome the shortcomings, the present invention provides a positioning device for a cymbal to mitigate or obviate the aforementioned problems.

SUMMARY OF THE INVENTION

The main objective of the invention is to provide a positioning device that holds a cymbal and changes the angular position of the cymbal with a stepless adjustment to advantage a precise angular position of the cymbal.

A positioning device for a cymbal in accordance with the present invention comprises a bracket, a clamp, a cymbal supporting assembly, two friction pads and a primary adjusting assembly. The bracket has a stationary clamping member. The clamp is mounted movably on the bracket and has a movable clamping member. The cymbal supporting assembly is mounted pivotally between the stationary clamping member of the bracket and the movable clamping member and has a friction wheel and a cymbal supporting rod. One of the friction pads is mounted between the stationary clamping member and one side of the friction wheel. The other friction pad is mounted between the movable clamping member and the other side of the friction wheel. The friction pads selectively presses respectively against the sides of the friction wheel of the cymbal supporting assembly. The positioning device with the friction pads precisely sets the angular position of the cymbal.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
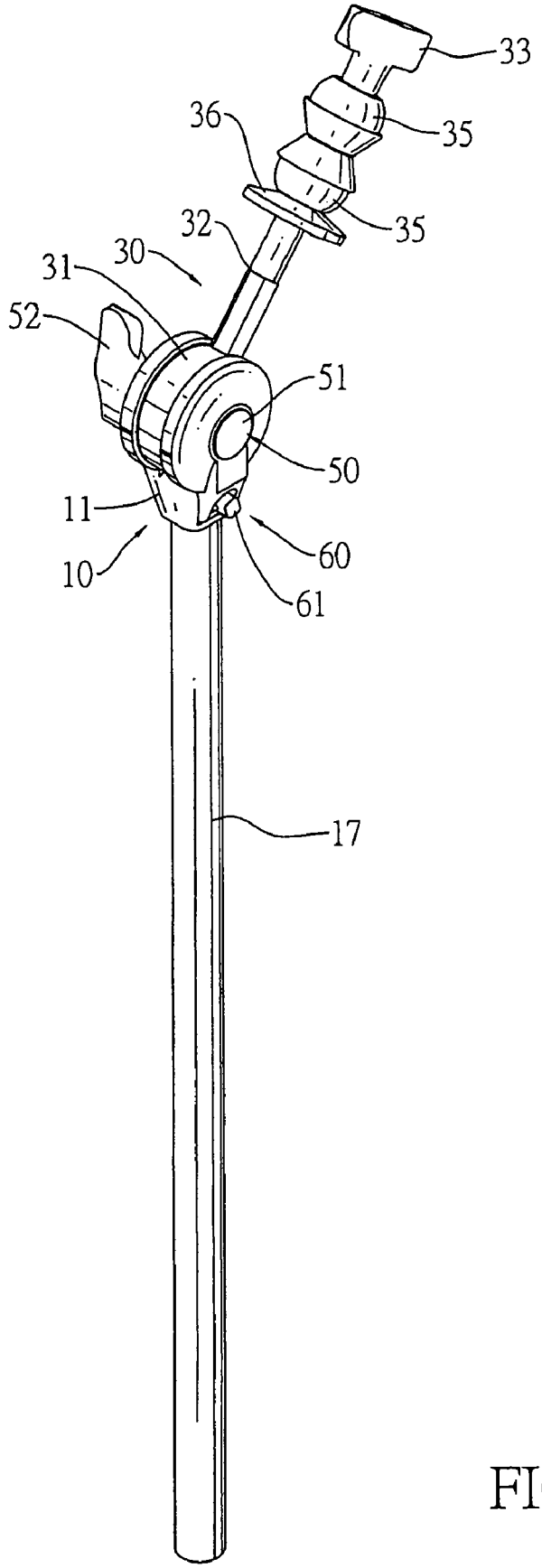
FIG. 1 is a perspective view of a position device for a cymbal in accordance with the present invention.
Figure 2:
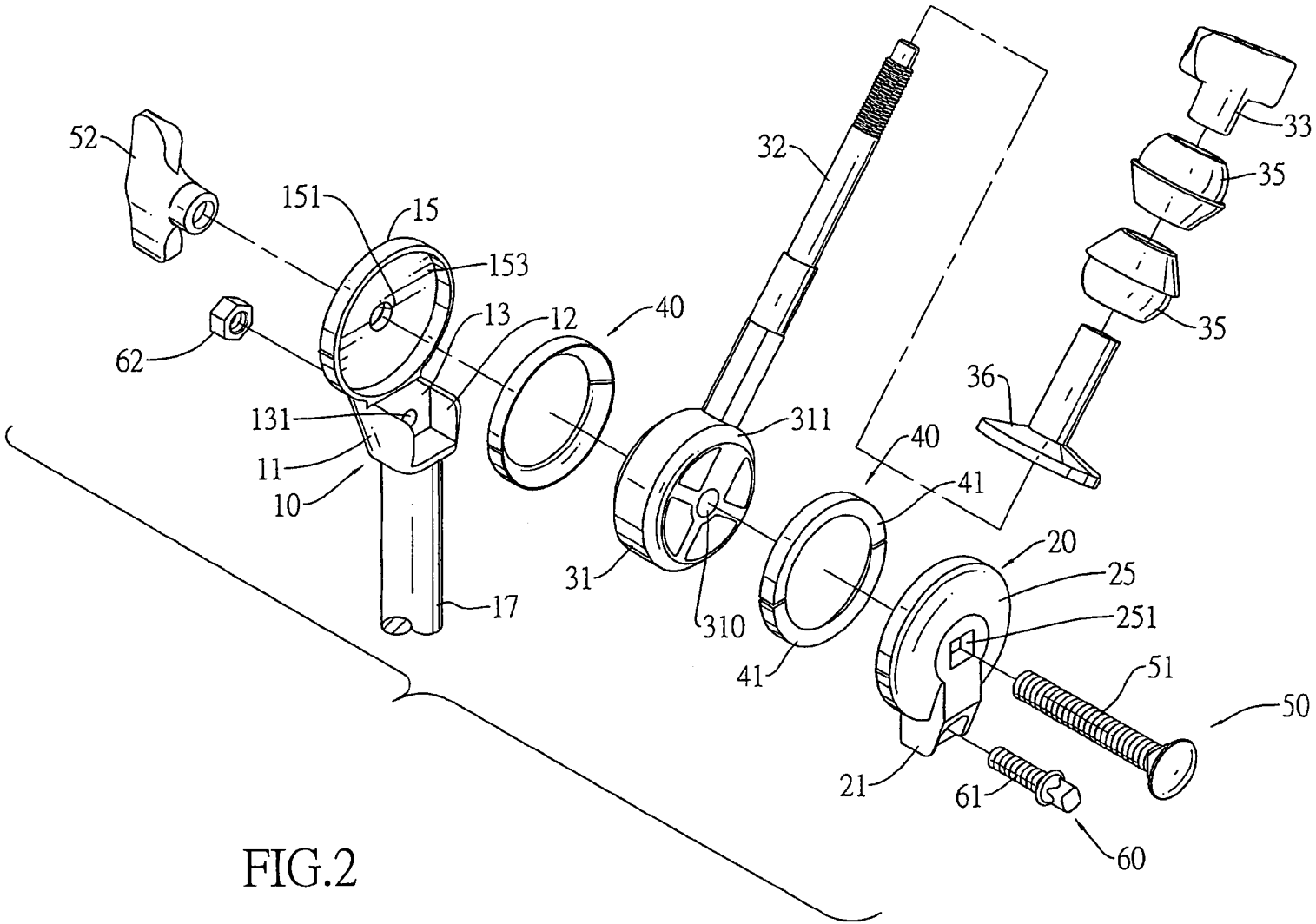
FIG. 2 is an exploded perspective view of the positioning device in FIG. 1.

With reference to FIGS. 1 and 2, a positioning device for a cymbal in accordance with the present invention comprises a bracket (10), a clamp (20), a cymbal supporting assembly (30), two friction pads (40), a primary adjusting assembly (50) and an auxiliary adjusting assembly (60).

The bracket (10) may be made of aluminum and has a base (11), a stationary clamping member (15) and a post (17).

The base (11) has a top, a bottom, an inside, an outside (13), a rail slot (12), and a mounting hole (131). The rail slot (12) is defined in inside and the top. The mounting hole (131) is defined through the outside (13) and communicates with the rail slot (12).

Figure 3:
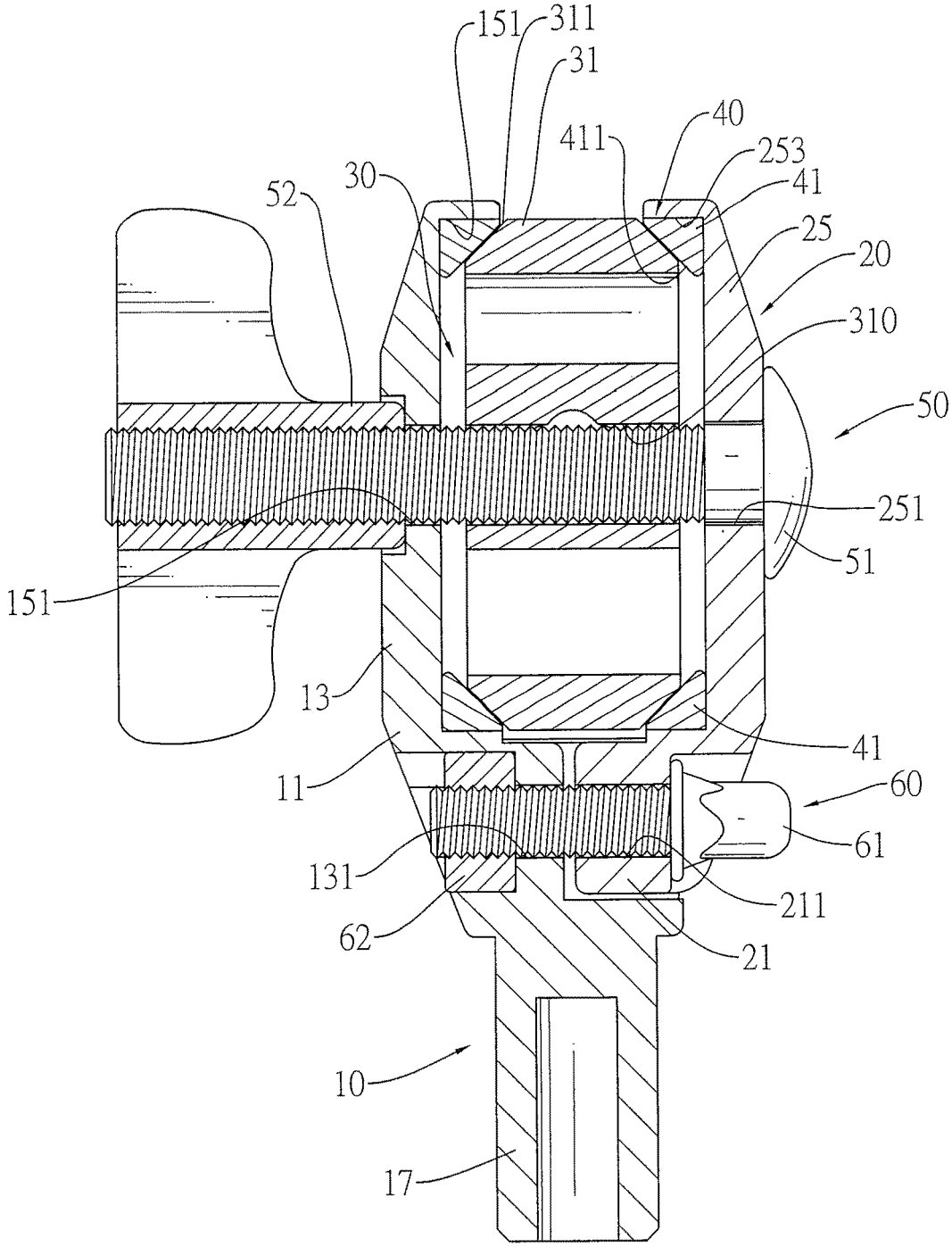
FIG. 3 is a side view in partially section of the positioning device in FIG. 1.
Figure 4:
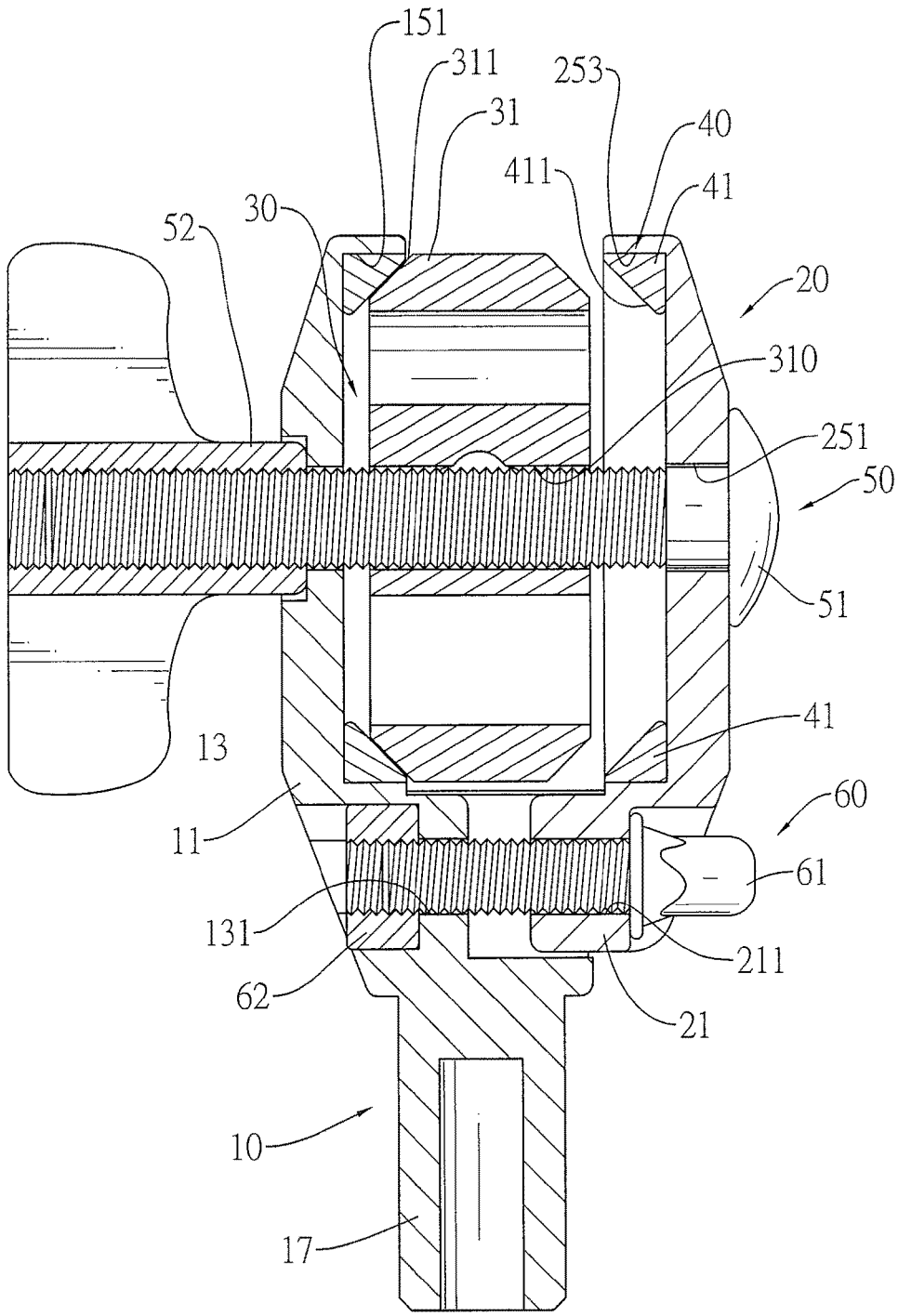
FIG. 4 is an operational side view in partial section of the positioning device in FIG. 3.

With further reference to FIGS. 3 and 4, the stationary clamping member (15) is circular, is formed on and protrudes up from the top of the base (11) and has an inside side, an outside, a central hole (151) and a mounting recess (153). The central hole (151) is defined through the stationary clamping member (15). The mounting recess (153) is defined in the inside.

The post (17) is formed on and protrudes from the base (11) and may be mounted to a foot to stand on the ground.

The clamp (20) may be made of aluminum, is mounted movably on the bracket (10) and has a mounting block (21) and a movable clamping member (25).

The mounting block (21) is mounted slidably in the rail slot (12) of the base (11) of the bracket (10). The rail slot (12) limits the mounting block (21) to move in a path parallel to axes of the stationary clamping member (15) and the movable clamping member (25). The mounting block (21) has a mounting hole (211). The mounting hole (21) is defined through the mounting block (21).

The movable clamping member (25) is formed on and protrudes up from the mounting block (21), is aligned with the stationary clamping member (15) and has an inside side, an outside, a central hole (251) and a mounting recess (253). The central hole (251) is defined through the movable clamping member (25). The mounting recess (253) is defined in the inside of the movable clamping member (25) and faces the mounting recess (153) of the stationary clamping member (15).

The cymbal supporting assembly (30) may be made of aluminum and is mounted pivotally between the stationary clamping member (15) of the bracket (10) and the movable clamping member (25) of the clamp (20). The cymbal supporting assembly (30) has a friction wheel (31) and a cymbal supporting rod (32) and may further have a sleeve, two resilient clamping elements (35) and a knob (33).

The friction wheel (31) is mounted rotatably between the stationary clamping member (15) and the movable clamping member (25) and has two opposite sides and a central bore (310). Each side has an annular outer beveled surface (311). The central bore (310) is defined through the friction wheel (31).

The cymbal supporting rod (32) is formed on and protrudes radially from the friction wheel (31), may hold a cymbal and has a distal end.

The sleeve is mounted around the cymbal supporting rod (32) and has an annular flange (36) formed on and protruding radially outwards from the sleeve.

The resilient clamping elements (35) are spherical, are mounted around the sleeve and cooperate with each other to clamp the cymbal therebetween. One of the resilient clamping elements (35) abuts against the annular flange (36).

The knob (33) is screwed on the distal end and selectively presses against one of the resilient clamping elements (35) to tightly clamp the cymbal.

The friction pads (40) are annular and resilient, may be made of rubber or acrylonitrile butadiene styrene (ABS). One of the friction pads is mounted between the stationary clamping member (15) and one side of the friction wheel (31) and the other friction pad (40) is mounted between the movable clamping member (25) and the other side of the friction wheel (31). The friction pads (40) selectively press respectively against the sides of the friction wheel (31) of the cymbal supporting assembly (30). The friction pads (40) may be mounted respectively to the mounting recesses (153, 253) of the stationary clamping member (15) and the movable clamping member (25). Each friction pad (40) has an annular inner beveled surface selectively pressing against one of the annular outer beveled surfaces (311) of the friction wheel (31). The friction pad (40) may be two semicircular pad members (41).

The primary adjusting assembly (50) is mounted through the stationary clamping member (15), the movable clamping member (25), the friction wheel (31) and the friction pads (40) and selectively presses the stationary clamping member (15), the movable clamping member (20) and the friction pads (40) towards the friction wheel (31) to securely hold the friction wheel (31). The friction wheel (31) held by the tightly compressed friction pads (40) positions the cymbal supporting rod (32) with the cymbal at a specific angular position. The primary adjusting assembly (50) has a primary bolt (51) and a primary knob (52).

The primary bolt (51) extends through the central holes (151, 251) of the stationary clamping member (15) and the movable clamping member (25), the central bore (310) of the friction wheel (31) and the friction pads (40) and has a mounting end, a connecting end and an enlarged head. The enlarged head is formed on the mounting end and abuts against the movable clamping member (25).

The primary knob (52) is screwed on connecting end of the primary bolt (51), abuts the stationary clamping member (15) and selectively compresses the stationary clamping member (15), the movable clamping member (25), the friction pads (40) and the friction wheel (31) so that the friction pads (40) press tightly against the friction wheel (31) to prevent the friction wheel (31) from inadvertently rotating.

The auxiliary adjusting assembly (60) is mounted through the base (11) and the mounting block (21) and selectively presses the stationary clamping member (25), the movable clamping member (25) and the friction pads (40) towards the friction wheel (31) to damp and slow rotation of the friction wheel (31). When the primary adjusting assembly (50) is released and the auxiliary adjusting assembly (60) is tightened, the friction wheel (31) pressed against the friction pads (40) rotates sluggishly or even stops rotating to prevent the cymbal on the cymbal supporting rod (32) from accidentally falling down. The auxiliary adjusting assembly (50) has an auxiliary bolt (61) and a nut (62).

The auxiliary bolt (61) extends through the mounting holes (131, 211) of the base (11) and the mounting block (21) and has a mounting end, a connecting end and an enlarged head. The enlarged head is formed on the mounting end of the auxiliary bolt (61), abuts against the mounting block (21), is polygonal and may be quadrangular or hexagonal, etc.

The nut (62) is screwed on the connecting end of the auxiliary bolt (61), abuts against the base (11) and selectively compresses the stationary clamping member (15), the movable clamping member (25), the friction pads (40) and the friction wheel (31) so that the friction pads (40) press against the friction wheel (31) to damp and slow the rotation of the friction wheel (31).

The positioning device having the primary adjusting assembly (50) and the friction pads (40) instead of key and keyway structures changes the angular position of the cymbal by a stepless adjustment. Therefore, the cymbal supporting assembly (50) may be positioned precisely without being limited by the numbers of the key and keyways.

Furthermore, the auxiliary adjusting assembly (60) may be tightened to slightly loosely hold the cymbal supporting assembly (30) when the primary adjusting assembly (50) is entirely released. Therefore, the auxiliary adjusting assembly (60) prevent the cymbal supporting assembly (30) from accidentally falling off when a user is releasing the cymbal supporting assembly (30) to change the angular position of the cymbal.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A positioning device for a cymbal comprising:

a bracket having a base; and a stationary clamping member formed on and protruding up from the base and having an inside and an outside;

a clamp mounted movably on the bracket and having a mounting block mounted in the base; and a movable clamping member formed on and protruding up from the mounting block and having an inside and an outside;

a cymbal supporting assembly mounted pivotally between the stationary clamping member of the bracket and the movable clamping member of the clamp and having a friction wheel mounted rotatably between the stationary clamping member and the movable clamping member and having two opposite sides and each side having an annular outer beveled surface; and a cymbal supporting rod formed on and protruding radially from the friction wheel, adapted to hold a cymbal and having a distal end;

two friction pads being annular and resilient, one of the friction pads mounted between the stationary clamping member and one side of the friction wheel, and the other friction pad mounted between the movable clamping member and the other side of the friction wheel, the friction pads selectively pressing respectively against the sides of the friction wheel of the cymbal supporting assembly and each friction pad having an annular inner beveled surface pressing against one of the annular outer beveled surfaces of the friction wheel; and a primary adjusting assembly is mounted through the stationary clamping member, the movable clamping member, the friction wheel and the friction pads and selectively pressing the stationary clamping member, the movable clamping member and the friction pads towards the friction wheel to securely hold the friction wheel.

2. The positioning device as claimed in claim 1 further comprising an auxiliary assembly mounted through the base and the mounting block and selectively pressing the stationary clamping member, the movable clamping member and the friction pads towards the friction wheel.

3. The positioning device as claimed in claim 2, wherein:

the stationary clamping member has a central hole defined through the stationary clamping member;

the movable clamping member has a central hole defined through the movable clamping member;

the friction wheel has a central bore defined through the friction wheel;

the primary adjusting assembly has a primary bolt extending through the central holes of the stationary clamping member and the movable clamping member, the central bore of the friction wheel and the friction pads and having a mounting end, a connecting end and an enlarged head formed on the mounting end; and a primary knob screwed on connecting end of the primary bolt and selectively compressing the stationary clamping member, the movable clamping member, the friction pads and the friction wheel.

4. The positioning device as claimed in claim 3, wherein:

the base has a top, a bottom, an inside, an outside and a mounting hole defined through the outside;

the mounting block has a mounting hole defined through the mounting block; and the auxiliary adjusting assembly has an auxiliary bolt extending through the mounting holes of the base and the mounting block and having a mounting end, a connecting end and an enlarged head formed on the mounting end; and a nut screwed on the connecting end of the auxiliary bolt and selectively compressing the stationary clamping member, the movable clamping member, the friction pads and the friction wheel.

5. The positioning device as claimed in claim 4, wherein:

the base further has a rail slot defined in the inside and the top; and the mounting block is mounted slidably in the rail slot and the rail slot limits the mounting block to move in a path parallel to axes of the stationary clamping member and the movable clamping member.

6. The positioning device as claimed in claim 5, wherein:

the stationary clamping member further has a mounting recess defined in the inside;

the movable clamping member further has a mounting recess defined in the inside; and the friction pads are mounted respectively in the mounting recesses of the stationary clamping member and the movable clamping member.

7. The positioning device as claimed in claim 6, wherein each friction pad has two semicircular pad members.

8. The positioning device as claimed in claim 7, wherein the cymbal supporting assembly further has a sleeve mounted around the cymbal supporting rod and having an annular flange formed on and protruding radially outwards from the sleeve;

two resilient clamping elements being ball-shaped, mounted around the sleeve and cooperating with each other to clamp the cymbal therebetween, and one of the resilient clamping elements abutting against the annular flange; and a knob screwed on the distal end of the cymbal supporting rod and selectively pressing against one of the resilient clamping elements.

9. The positioning device as claimed in claim 8, wherein the friction pads are made of acrylonitrile butadiene styrene.

10. The positioning device as claimed in claim 8, wherein the friction pads are made of rubber.

* * * * *